US007017881B2

(12) United States Patent
Ward

(10) Patent No.: US 7,017,881 B2
(45) Date of Patent: Mar. 28, 2006

(54) BLOWOUT PREVENTER RAM PACKER AND WEAR INSERT

(75) Inventor: Michael W. Ward, Houston, TX (US)

(73) Assignee: Petroleum Elastomers, Inc, Houston, TX (US)

( * ) Notice: Subject to any disclaimer, the term of this patent is extended or adjusted under 35 U.S.C. 154(b) by 146 days.

(21) Appl. No.: 10/727,797

(22) Filed: Dec. 4, 2003

(65) Prior Publication Data

US 2004/0113108 A1 Jun. 17, 2004

Related U.S. Application Data

(60) Provisional application No. 60/430,830, filed on Dec. 4, 2002.

(51) Int. Cl.
*F16K 51/00* (2006.01)
*E21B 33/06* (2006.01)

(52) U.S. Cl. ..... 251/1.3; 277/324

(58) Field of Classification Search ..... 251/1.3, 251/1.1; 277/324, 325

See application file for complete search history.

(56) References Cited

U.S. PATENT DOCUMENTS

| | | | | | |
|---|---|---|---|---|---|
| 2,760,749 | A | * | 8/1956 | Ratigan | 251/1.3 |
| 4,323,256 | A | * | 4/1982 | Miyagishima et al. | 277/325 |
| 4,398,729 | A | | 8/1983 | Bishop et al. | 277/73 |
| 4,541,639 | A | | 9/1985 | Williams, III | 277/73 |
| 4,844,406 | A | * | 7/1989 | Wilson | 251/1.3 |
| 5,127,623 | A | * | 7/1992 | McDugle | 251/1.3 |
| 5,251,870 | A | | 10/1993 | Ward | 251/1.3 |
| 5,603,481 | A | | 2/1997 | Parker et al. | 251/1.3 |
| 5,833,208 | A | * | 11/1998 | Lee, Jr. | 251/1.3 |
| 6,296,225 | B1 | * | 10/2001 | Watts | 251/1.3 |

* cited by examiner

*Primary Examiner*—John Bastianelli
(74) *Attorney, Agent, or Firm*—Kenneth H. Johnson

(57) ABSTRACT

A ram packer for a hydraulic blowout preventer is provided that includes a steel reinforced hard elastomeric body which has a recess in the packer face for receiving a replaceable wear insert having shoulders on the insert surfaces that are relieved. By relieving the shoulders of the configuration where they come into contact with the ram packer, a projection is created to make contact with the ram packer while leaving an elastomer flow pathway for the reservoir elastomer of the ram packer. This projection does not inhibit rotation of the wear insert, but is a spacer to hold a portion of the insert away from the back of the ram packer. The wear insert may be made of various materials according to the service in which used.

24 Claims, 5 Drawing Sheets

BLOWOUT PREVENTER RAM PACKER AND WEAR INSERT

This application claims the benefit of provisional application 60/430,830 filed Dec. 4, 2002.

BACKGROUND OF THE INVENTION

1. Field of the Invention

The present invention relates to ram type blowout preventers which are hydraulically activated to seal about a pipe string of an oil or gas well to confine and control the pressure therein. More particularly the invention relates to replaceable wear inserts which seal about the pipe and which may be replaced when worn, thus saving the ram for further use. Most particularly the invention relates to replaceable wear inserts for use with heavy rubber ram packers having improved elastic flow characteristics.

2. Related Art

There are many styles of ram type blowout preventers available. One style, as illustrated in U.S. Pat. No. 4,825,948 issued to Carnahan comprises a ram body with a remotely replaceable shoe assembly, the sealing surface being integral with the shoe. The patent discloses ram shoes that are remotely removable and replaceable and includes a good background discussion of blowout preventers in general.

Generally a wear insert is placed in a cutout on the face of a ram front body. The body of such a ram is usually of a heavy rubber material and the wear insert of an elastomeric material such as TEFLON or high molecular weight polyethylene. The wear insert may be retained within the ram packer by radial fasteners such as screws.

U.S. Pat. No. 4,398,729 issued to Bishop, et al. has a ram body with a ram front packing including a backing portion of elastomeric material and a replaceable insert portion also of an elastomeric material having a detent on the outer surface of the seal insert, such as, a pair of securing members extending from the sides of the wear insert to prevent rotation. At column 4 at lines 22–27, the patent discloses that the shape of the insert that fits in the ram packer can have any configuration, such as a rectangular or multi-sided, in addition to the semicircular shape shown, so long as the seal member of the packer corresponds with a detent on the insert seal. The securing members and the corresponding notches in the ram packer, serve to prevent lateral rotation in and horizontal displacement out of the detent when the packer is drawn back from the pipe string. Thus, the configuration of the insert as either rectangular or multi-sided with a projection thereon is old and well known in the art from U.S. Pat. No. 4,541,639.

The elastomer comprising the ram packer forms a reservoir, such that as the surface in contact with the rotating pipe is worn away, the elastomer reservoir in the ram packer supplies additional elastomer to pressure the insert into the depleted areas. The ability to obtain as long a useful life as possible for the wear insert, depends on the ability of the elastomer in the reservoir to have flow access throughout the entire ram packer.

It has been found that when the multi-sided wear inserts of the prior art, are used the shoulders, which form the rectangle and the multi-sided configuration come into contact or very near to contact with the back of the ram packer to form a blockage of the elastomer flow from the reservoir to areas requiring increased pressure. The inhibition of the elastomer flow hastens the failure of the wear insert seal with the pipe, requiring its premature replacement and resulting lost drilling time.

It is an advantage of the present invention that the present wear insert provides a pathway for elastomer flow through the ram packer even when the configured shoulders would otherwise be fully compressed against the back of the ram packer.

SUMMARY OF THE INVENTION

Briefly the present invention is a wear insert for axially slidable engagement in a ram packer of a blowout preventer comprising a sealing surface having a semicircular face preferably having a radius substantially equal to the pipe against which it is to be used and a ram packer mounting surface having a multi-sided configuration wherein the shoulders defining the configuration on the mounting surface opposite to the semicircular face are relieved. The shoulders on the mounting surface opposite the semicircular face may be relieved in several ways to obtain the benefits of the present invention. In one preferred embodiment a beveled projection extends from the wear insert about the shoulders defining the configuration of the mounting surface opposite to the semicircular surface. In a second preferred embodiment a slot extending through the wear seal, through the shoulders defining the configuration of the mounting surface opposite to the semicircular surface, forms a pair of projections extending from the wear insert. By relieving the shoulders of the configuration where they come into contact with the ram packer, a projection is created to make contact with a ram packer while leaving an elastomer flow pathway for the reservoir elastomer of the ram packer. The overall configuration remains the same for seating purposes while the projecting portion inhibits full contact of shoulders with the ram packer. The present insert is adapted for lateral insertion into a depression in the packer face corresponding and conforming to an unrelieved wear insert.

The present invention also comprises a ram packer of an elastomeric material such as heavy rubber having a recessed slot or cutout configured to conform to and receive said wear insert of, for example a similar or different elastomeric material, and the combination of said ram packer and said insert. By reducing the portion of the wear insert that actually comes into contact or near contact with the back of the ram packer the elastomer flow is achieved over the major portion of the surface of the wear insert in contact with the ram packer. Preferably the terminus of the projection from the wear insert is less than 50%, more preferably less than 75% of the surface defined by the extension of the sides of the wear insert to the plane of the terminus.

The wear insert has an insertion surface around the periphery which engages in the recessed slot or cutout of the ram packer. To prevent rotation of the wear insert as it engages the pipe, the configuration of the insertion surface is multi-sided around the periphery, conformed to the projection and is engaged by a matching shape of the slot or cutout in the ram packer.

BRIEF DESCRIPTION OF THE DRAWINGS

FIG. 16 is an isometric view of the wear insert of FIG. 13.

DESCRIPTION OF THE PREFERRED EMBODIMENTS

Figure 17:
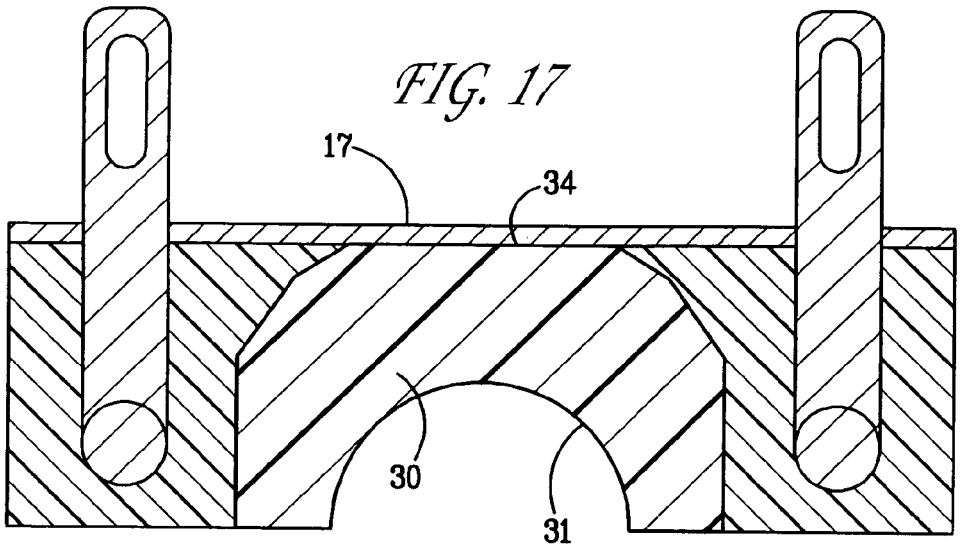
FIG. 17 is cross sectional view of the wear insert of FIGS. 1–4 seated in a ram packer prior to use.
Figure 18:
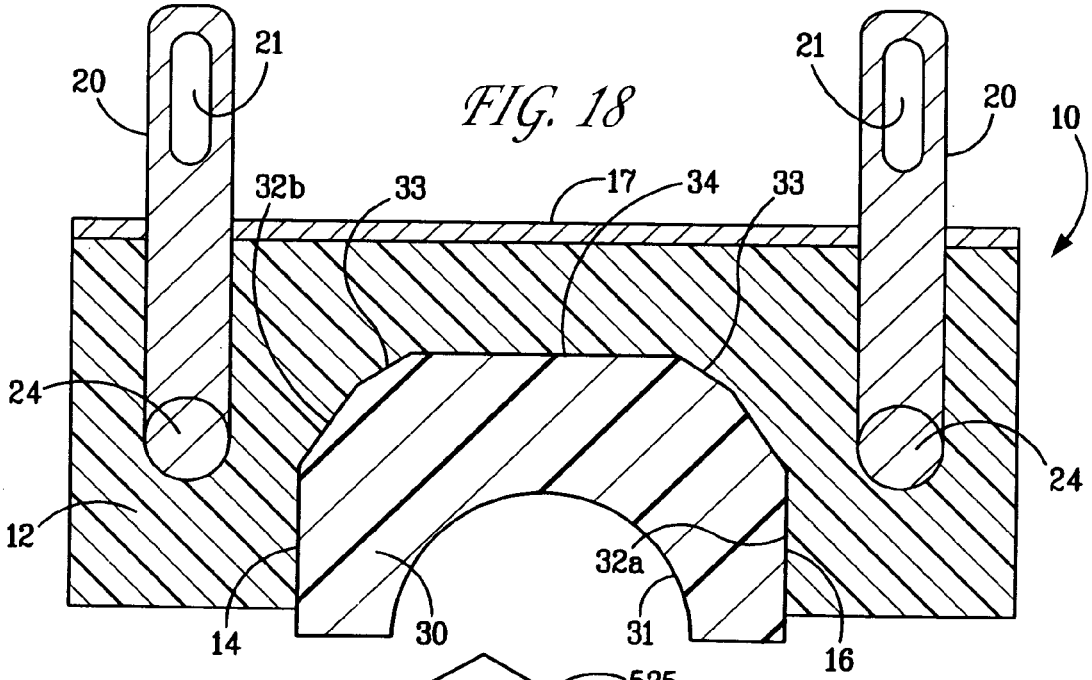
FIG. 18 is cross sectional view of the wear insert of FIGS. 1–4 seated in a ram packer after use.

Referring now to FIGS. 17 and 18, the ram packer 10 is shown with the wear insert 30 in place. The ram packer is seen to comprise packer body 12 of a heavy elastomeric material such as butyl rubber which acts as a reservoir to distribute the force generated by the hydraulic ram evenly about the wear insert 30. Wear insert 30 fits snugly into recess between sides 14 and 16 and may be made of various materials depending upon the service in which the ram packer is to be used. Extending from the rear through back plate 17 of the ram packer are lugs 20 with slots 21 which are for engagement by pins into a ram assembly (not shown). Rods 24 secure the lugs 20 in the ram packer body. The insertion surfaces 32A and 32B should fit snugly into a matching recess within the ram packer having a sealing surface 31. The wear insert may be held in recess by radial screws (not shown) of soft brass mounted and counter set on the seal surface of the insert to prevent lateral movement within the recess.

The wear insert depicted in FIGS. 17 and 18 is that of FIGS. 1–4. The insert surfaces 32B are beveled to remove the shoulders 35 show in FIG. 19 the prior art wear insert 530. The terminal surface 534A of FIG. 19 has shoulders 535, which would be closest to back plate 17 when the wear insert is inserted into a ram packer. These shoulders were found to block the elastomer flow as the insert was depressed to the back plate as shown in FIG. 17 thereby not fully utilizing the elastomer reservoir. By relieving the shoulders, such as with the bevels as show in FIGS. 1–4, 17 and 18, the elastomer flow can continue along the surfaces 33. The terminus 34 of wear insert 30 with the beveled shoulders is reduced compared to that of 530.

Figure 19:
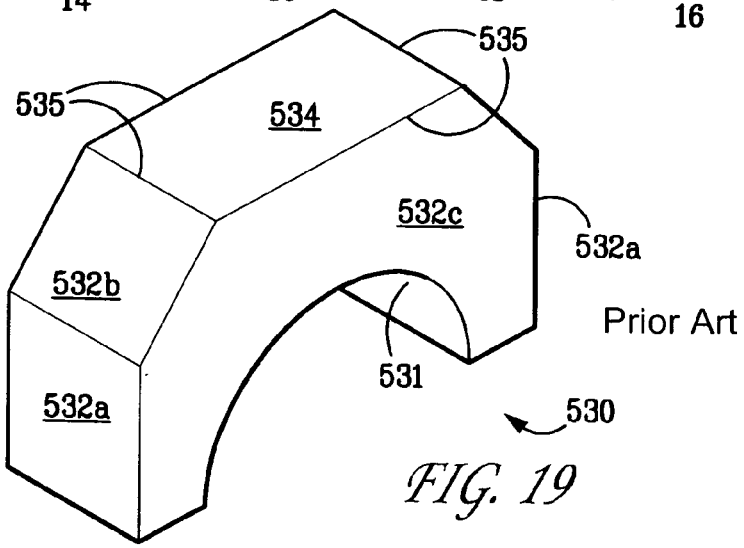
Prior Art FIG. 19
FIG. 19 is a wear insert 530 of the prior art.

FIG. 19 discloses a prior art wear insert 530 having a pair of parallel surfaces 532C, a second par of parallel surfaces 532A, a pair of intersecting surfaces 532B, which terminate prior to intersecting to form the terminus surface 534, surrounded by shoulder 535 and having a sealing surface 531.

Figure 1:
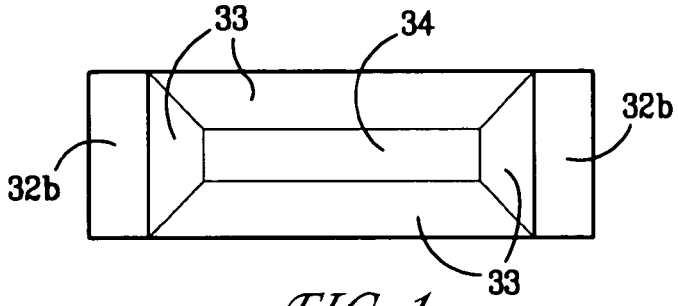
FIG. 1 is an in plan view of the mounting surface of an embodiment wear insert of the present invention.
Figure 2:
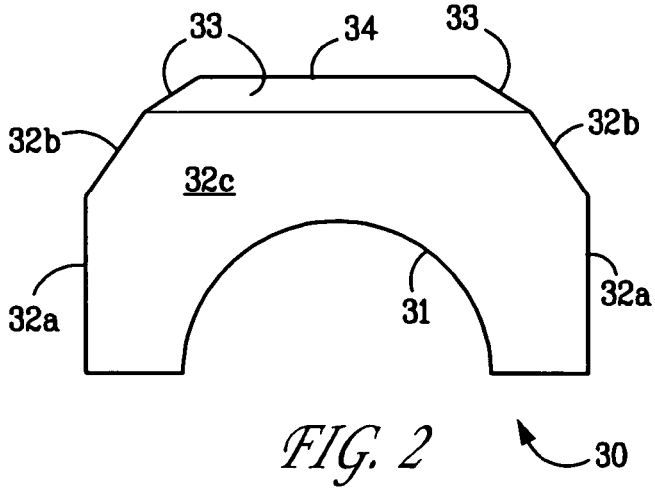
FIG. 2 is a front plan view of the wear insert of FIG. 1.
Figure 3:
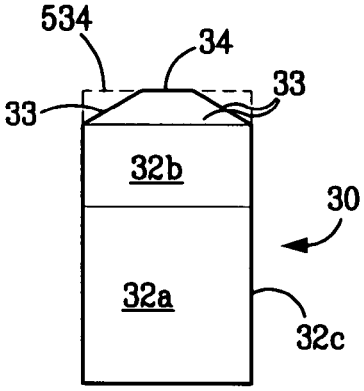
FIG. 3 is a side plan view of the wear insert of FIG. 1.
Figure 4:
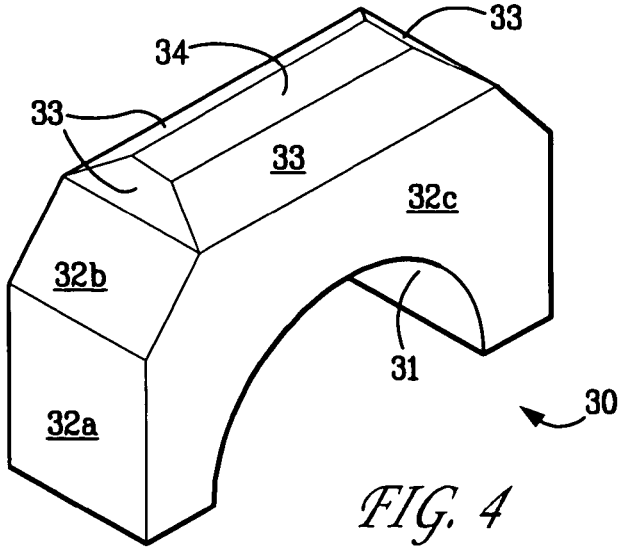
FIG. 4 is an isometric view of the wear insert 30 of FIG. 1.
Figure 5:
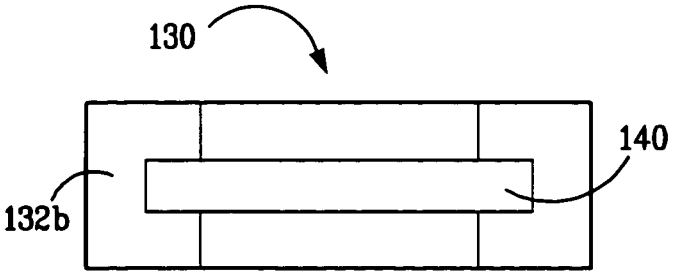
FIG. 5 is an in plan view of the mounting surface of an alternative embodiment wear insert of the present invention.
Figure 6:
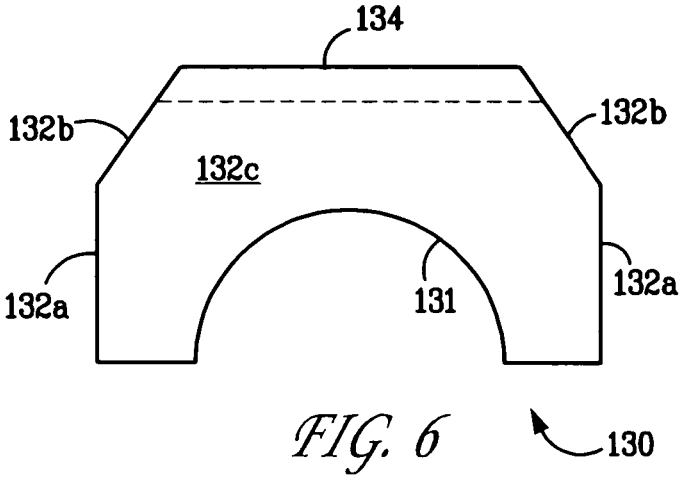
FIG. 6 is a front plan view of the wear insert of FIG. 5.
Figure 7:
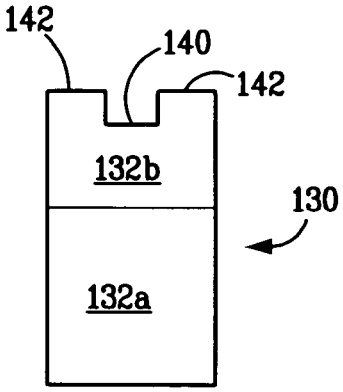
FIG. 7 is a side plan view of the wear insert of FIG. 5.
Figure 8:
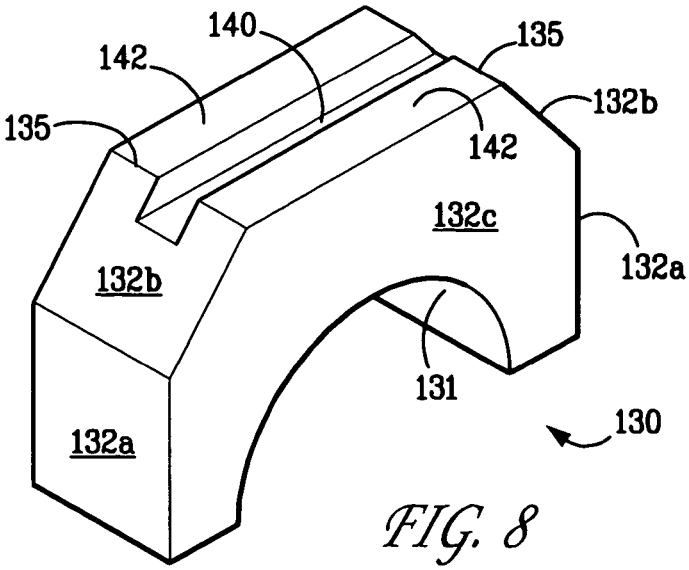
FIG. 8 is an isometric view of the wear insert of FIG. 5.
Figure 9:
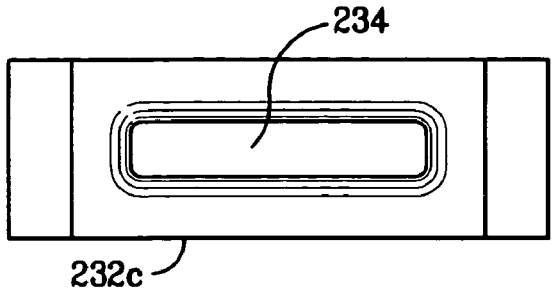
FIG. 9 is an in plan view of the mounting surface of a second alternative embodiment wear insert of the present invention.
Figure 10:
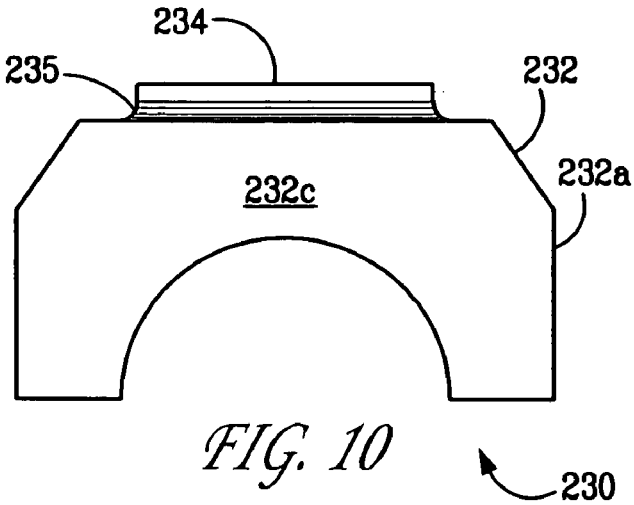
FIG. 10 is a front plan view of the wear insert of FIG. 9.
Figure 11:
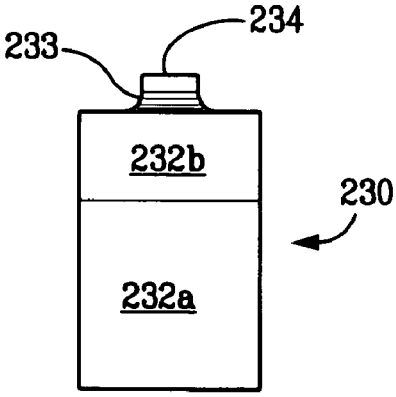
FIG. 11 is a side plan view of the wear insert of FIG. 9.
Figure 12:
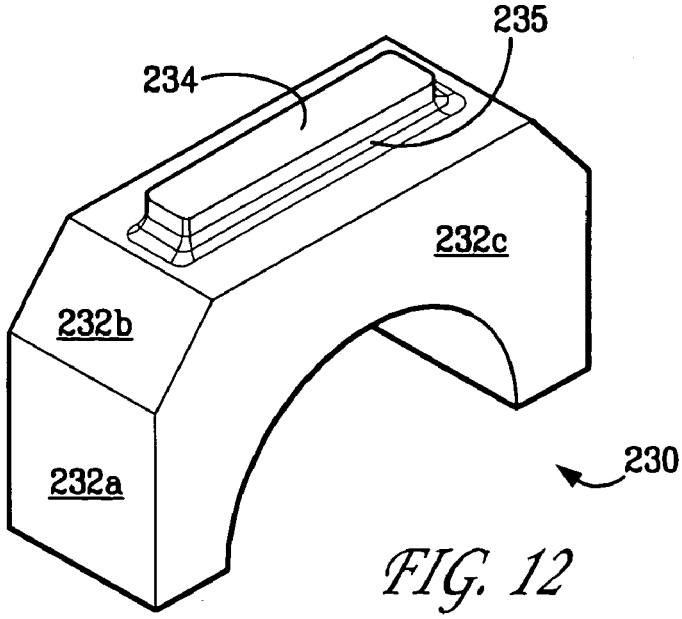
FIG. 12 is an isometric view of the wear insert of FIG. 9.
Figure 13:
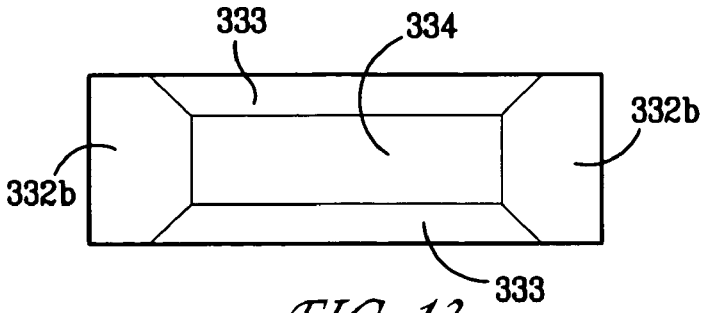
FIG. 13 is an in plan view of the mounting surface of a third alternative embodiment wear insert of the present invention.
Figure 14:
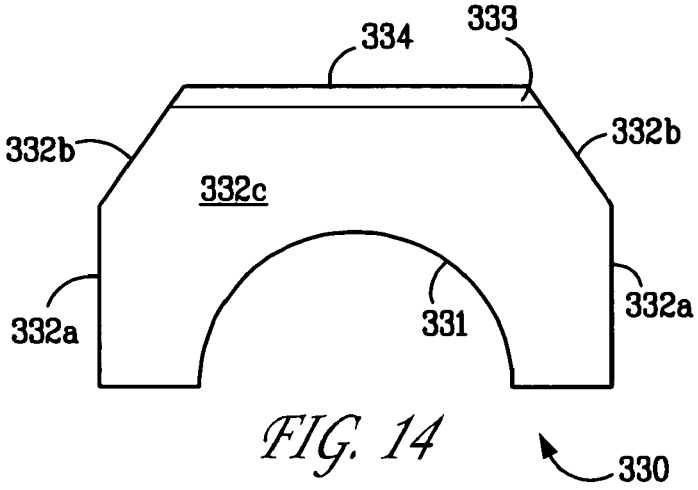
FIG. 14 is a front plan view of the wear insert of FIG. 13.
Figure 15:
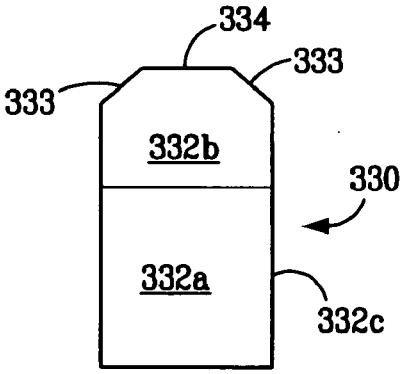

FIGS. 1–4 disclose wear insert 30 having a pair of parallel surfaces 32C, a second par of parallel surfaces 32A, a pair of intersecting surfaces 32B, which terminate prior to intersecting to form the terminus surface 34, surrounded by beveled surfaces 33 and having a sealing surface 31. It is preferred that the area of the prior art surface 534 as shown in FIG. 19 is reduced by at least 50% by the relief of the shoulders to form a pathway for elastomer flow. Stated in terms of the present insert of FIGS. 1–4 the terminus 34 formed by the bevels 33 is at least 50% less, preferably 75% less than the area of the plane of the terminus determined by extending the sides 32B and 32C of the present insert (FIG. 3) through the plane of terminus 34 as shown in FIG. 3, said plane defined by the extensions of the 32B and 32C and corresponding to the area of terminus surface 534 of the prior art wear insert of FIG. 19. Preferably the angle of the bevels may be in the range of 10 to 40°.

In FIGS. 5–8 disclose a wear insert 130 having a pair of parallel surfaces 132C, a second par of parallel surfaces 132A, a pair of intersecting surfaces 132B, which terminate prior to intersecting to form the terminus surface 134, surrounded by shoulders 135 and having a sealing surface 131. The shoulder 135 is relieved by a slot or channel 140 extending through the shoulder on one surface 132B to the opposing surface 132B and shoulder 135. The elastomer flow is obtained between the extensions 142, as formed by the slot, which extensions project from the body of the wear insert and preventing the wear insert from sealing fully against the ram packer.

FIGS. 9–12 disclose wear insert 230 having a pair of parallel surfaces 232C, a second par of parallel surfaces 232A, a pair of intersecting surfaces 232B, which terminate prior to intersecting to form the terminus surface 234, surrounded by cove surfaces 233 and having a sealing surface 231. In essence the shoulders 535 of the prior art wear insert 530 have been totally relieved to form a cove 233 and a portion 235 projecting outward from the body of the wear insert to allow elastomer flow.

Figure 16:
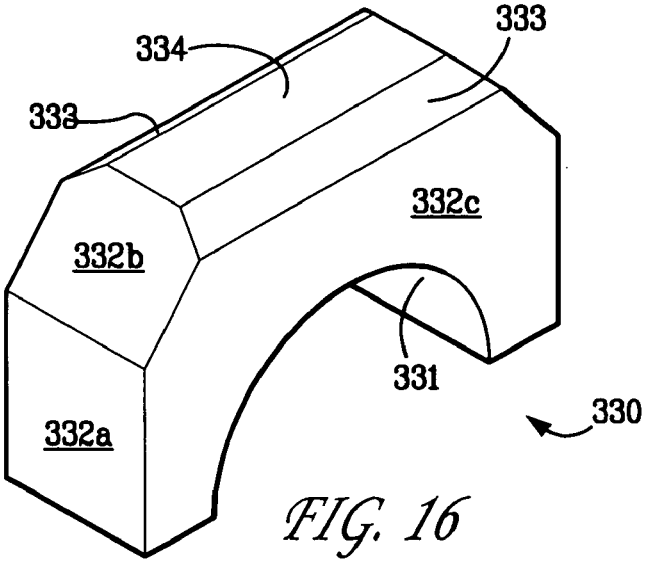
FIG. 16 is a side plan view of the wear insert of FIG. 13.

FIGS. 13–16 disclose wear insert 330 having a pair of parallel surfaces 332C, a second par of parallel surfaces 332A, a pair of intersecting surfaces 332B, which terminate prior to intersecting to form the terminus surface 334, beveled surfaces 333 and having a sealing surface 331. Stated in terms of the present insert of FIGS. 13–16 the terminus 334 formed by the bevels 333 is less than the area of the plane of the terminus determined by extending the sides 332C of the present insert (FIG. 16) through the plane of terminus 334 as shown in FIG. 16, said plane defined by the extensions of 332C surfaces and corresponding to the area of terminus surface 534 of the prior art wear insert of FIG. 19. Preferably the angle of the bevels may be in the range of 10 to 40°.

The elements of the present wear inserts which extend or project from the main body of the insert are distinguished from the projections of the prior art in their functionality. In the prior art there are projections which serves only to engage the ram packer, to hold the insert in place, to prevent movement. The present projections have no function for preventing movement of the wear insert in the ram packer but are for providing pathways of elastomer flow within the ram packer.

The invention claimed is:

1. A wear insert for a ram packer for axially slidable engagement in a ram packer of a blowout preventer comprising:

(a) a sealing surface having a semicircular face and (b) a ram packer mounting surface having a multi-sided configuration having a first pair of parallel sides having terminal ends, second pair of parallel sides, a pair of non parallel sides extending from said second pair of parallel sides, said non parallel sides having terminal ends distal to said second pair of parallel sides, a first area defined by a plane through said terminal ends of said non parallel sides and said first pair of parallel sides and at least one projection for spacing said wear insert away from a seating surface of a ram packer said projection terminating in a second area, said second area being less than said first area, and said projection extending from said first area, wherein said projection does not prevent rotation of said wear insert, while allowing for elastomer flow through the ram packer even when the configured shoulders would otherwise be fully compressed against the back of the ram packer.

2. The insert according to claim 1 wherein said projection comprises beveled surfaces extending from said first area to said second area.

3. The insert according to claim 1 comprising two projections formed by a slot through said mounting surface.

4. The insert according to claim 1 wherein said projection comprises a cove extending between said first and second areas.

5. The insert according to claim 1 wherein said projection comprises beveled surfaces extending from said first area along the terminal ends of said first pair of parallel sides to said second area.

6. The insert according to claim 1 wherein said projection comprises beveled surfaces extending from said first area to said second area along the terminal ends of said non parallel sides and said first pair of parallel sides.

7. The insert according to claim 1 wherein said second area is less than 50% than said first area.

8. The insert according to claim 1 wherein said second area is less than 75% than said first area.

9. The insert according to claim 1 wherein said bevels have an angle in the range of 10 to 40°.

10. The combination comprising a ram packer of an elastomeric material having a recessed slot or cutout configured to conform to and receive a wear insert for a ram packer of a blowout preventer comprising:

(a) a sealing surface having a semicircular face and (b) a ram packer mounting surface having a multi-sided configuration having a first pair of parallel sides having terminal ends, second pair of parallel sides, a pair of non parallel sides extending from said second pair of parallel sides, said non parallel sides having terminal ends distal to said second pair of parallel sides, a first area defined by a plane through said terminal ends of said non parallel sides and said first pair of parallel sides and at least one projection for spacing said wear insert away from a seating surface of a ram packer said projection terminating in a second area, said second area being less than said first area, and said projection extending from said first area, wherein said projection does not prevent rotation of said wear insert, while allowing for elastomer flow through the ram packer even when the configured shoulders would otherwise be fully compressed against the back of the ram packer.

11. The insert according to claim 10 wherein said projection comprises beveled surfaces extending from said first area to said second area.

12. The insert according to claim 10 comprising two projections formed by a slot through said mounting surface.

13. The insert according to claim 10 wherein said projection comprises a cove extending between said first and second areas.

14. A ram packer for use in a hydraulic blowout preventer comprising:

(a) a body of hard elastomeric material having attachment means on the rear for attachment to a hydraulic ram and a packer surface opposite said attachment means;

(b) a recess in said packer surface for receiving a replaceable wear insert, said recess defining a substantially multi-sided shape toward the rear thereof; and (c) a replaceable wear insert for disposition within said recess including a sealing surface having a multi-sided configuration having a first pair of parallel sides having terminal ends, second pair of parallel sides, a pair of non parallel sides extending from said second pair of parallel sides, said non parallel sides having terminal ends distal to said second pair of parallel sides, a first area defined by a plane through said terminal ends of said non parallel sides and said first pair of parallel sides and at least one projection for spacing said wear insert away from a seating surface of a ram packer said projection terminating in a second area, said second area being less than said first area, and said projection extending from said first area, wherein said projection does not prevent rotation of said wear insert, while allowing for elastomer flow through the ram packer even when the configured shoulders would otherwise be fully compressed against the back of the ram packer.

15. The ram packer according to claim 14 wherein said body further comprises two parallel plates retained in spaced relation with one another by two rods and said hard elastomeric material is molded about said plates and rods.

16. The ram packer according to claim 15 wherein said attachment means comprises a pair of lugs extending from the rear of said body, one each of said lugs being connected to one each of said rods.

17. The ram packer according to claim 14 wherein said hard elastomeric material is butyl rubber.

18. The ram packer according to claim 14 wherein said wear insert comprises high molecular weight polyethylene.

19. The ram packer according to claim 14 wherein said wear insert comprises TEFLON.

20. The ram packer according to claim 14 wherein the shape of said recess and said insertion surface comprises at least two parallel surfaces normal to said packer surface.

21. The ram packer according to claim 16 wherein said hard elastomeric material is butyl rubber.

22. The ram packer according to claim 21 wherein said projection comprises beveled surfaces extending from said first area to said second area.

23. The ram packer according to claim 22 wherein said wear insert comprises high molecular weight polyethylene.

24. The ram packer according to claim 22 wherein said wear insert comprises TEFLON.

* * * * *